US005354930A

United States Patent [19]

Atkins et al.

[11] Patent Number: 5,354,930

[45] Date of Patent: Oct. 11, 1994

[54] PROCESS FOR CONVERTING POLYMERS BY CONTACTING SAME WITH PARTICULATE MATERIAL SUSPENDED IN A TOROIDAL SHAPE

[75] Inventors: Martin P. Atkins, Ashford; David A. Kidd, Fleet, both of England

[73] Assignee: BP Chemicals Limited, London, England

[21] Appl. No.: 76,233

[22] Filed: Jun. 11, 1993

[30] Foreign Application Priority Data

Jun. 29, 1992 [GB] United Kingdom ..... 9213772
Jul. 21, 1992 [GB] United Kingdom ..... 9215494

[51] Int. Cl.[5] ..... C07C 1/00; C07C 4/00
[52] U.S. Cl. ..... 585/241; 585/240
[58] Field of Search ..... 585/240, 241

[56] References Cited

U.S. PATENT DOCUMENTS 4,948,495 8/1990 Coburn ..... 585/241
4,960,440 12/1990 Betz ..... 585/241

FOREIGN PATENT DOCUMENTS 0068853 1/1983 European Pat. Off. .
WO9300154 1/1993 World Int. Prop. O. .

*Primary Examiner*—Asok Pal
*Attorney, Agent, or Firm*—Brooks Haidt Haffner & Delahunty

[57] ABSTRACT

This invention relates to a method of cracking polymers, especially waste hydrocarbon polymers to produce products of lower molecular weight. The process comprises feeding the polymer into a processing chamber or circular-cross section which chamber also has a bed of particulate material maintained in suspension and in toroidal shape by a hot gas introduced into said chamber so that the polymer intermingles with the particulate materials of the bed and is cracked into products of lower molecular weight. The invention is useful for converting polymeric wastes into products of commercial value such as e.g. waxes, lubricants and monomeric olefins at the same time reducing environmental pollution.

11 Claims, No Drawings

PROCESS FOR CONVERTING POLYMERS BY CONTACTING SAME WITH PARTICULATE MATERIAL SUSPENDED IN A TOROIDAL SHAPE

This invention relates to a process for the conversion of polymers, particularly hydrocarbon polymer waste material to obtain useful products of lower molecular weight than the starting polymer (lighter products).

At the present time large amounts of polymer, particularly polyethylene, polypropylene, polystyrene, PVC and polyethylene terephthalate (hereafter "PET") are used for packaging and other applications and after use this material becomes a waste product. Much of this waste product is collected as domestic or industrial refuse and may either be deposited in a land fill site, or, recycled by mechanical means for conversion of waste polyethylene into low grade refuse bags, or, destroyed by burning. This represents not only a potential environmental hazard but also a waste of a potentially valuable resource.

It is an object of the present invention to provide a process for the conversion of polymers, particularly hydrocarbon polymers such as polyethylene and polypropylene, into useful products of lower molecular weight and thereby reduce environmental pollution.

SUMMARY OF THE INVENTION

Accordingly, the present invention is a process for the conversion of a polymer, especially hydrocarbon polymers, into products of lower molecular weight than the starting polymer, said process comprising:

a. generating in a processing chamber of circular cross-section in its vertical orientation a stream of hot gas which flows in an angular and upward direction causing
   (i) a bed of particulate material to be entrained in the flow of the gas and be held in suspension in a toroidal shape and
   (ii) the polymer introduced into said chamber in turn to intermingle with the particulate material and assume said toroidal shape thereby cracking said polymer into products of lower molecular weight, and
b. recovering said products of lower molecular weight from said chamber.

DETAILED DESCRIPTION

The polymer is suitably selected from one or more of polyethylene, polypropylene, polystyrene, PVC and PET, and is preferably a polyolefin or polystyrene. Such polymers which are used as feed are suitably waste polymers which may be discarded items of wrapping or packaging or plastics containers or off-cuts from polymer processing. Where such waste polymers are used these are suitably separated from any solid non-polymeric materials such as e.g. metallic components etc prior to being fed into the processing chamber. For the purposes of the present invention it is not necessary to completely remove such non-polymeric material as the processing chamber can be adapted to remove a slag of non-crackable or solid byproducts from said chamber e.g. by a central discharge facility. The polymer is suitably introduced into the processing chamber in the form of strips, pellets, extrudates of short lengths or as a melt. Where it is introduced as strips, pellets or extrudates, these are suitably of a size of about 1–2cm$^2$.

The bed of particulate material suitably includes catalytic and/or non-catalytic materials such as e.g. an acidic and/or basic catalysts which may be a zeolite, clay or amorphous silica-alumina, silica, quartz, alumina, zirconia, incineration pellets e.g. sand or ceramics, and the like. The bed may also contain other materials such as e.g. limestone or calcium oxide which can be distributed in the bed in a manner which enables any acidic vapours such as e.g. HCl from halogenated polymer wastes such as e.g. PVC to be trapped. Where the polymer to be cracked contains significant quantities of PVC, such a polymer may be co-fed with a material capable of trapping acidic vapours such as HCl e.g. lime or calcium oxide. In such a process the used slag can be removed from the reaction chamber by a central discharge facility. The size of these particles is not of particular importance except that they should neither be ejected nor drop out of the reaction chamber under the reaction conditions. Thus, the bulk density of the particulate material used will have some bearing on the particle size thereof. For instance, if sand—which has a relatively high bulk density—is used, the particle size should be relatively small e.g. less than 500 μm. The bed of material is suitably closely packed and the bed may optionally be fluidized.

The processing chamber of circular-cross section in its vertical orientation is suitably of a cylindrical shape into which the hot gas is introduced from the base thereof and the polymer to be cracked can be introduced either from the top thereof or via a side feed directly into the bed of particulate material. The hot gas is introduced into the chamber in the form of a jet stream which passes through a series of angular blades arranged in a circular shape corresponding to the internal circumference of the processing chamber at its widest internal diameter. This configuration causes the hot gas directed at the underside of the blades at an angle parallel to the axis of the chamber to be deflected by the blades and emerge into the chamber at an angle away from the axis and towards the circumference of the chamber. The continuous upward flow of the hot gas causes any particles entrained in the flow such as e.g. the bed of particulate material in the chamber to assume a toroidal shape. This effect is accentuated by the gravitational effect which urges the entrained particles to fall back. However, the ratio of the mass of the entrained particles and the velocity of flow of the hot gas is so selected that they enable the particles of the bed to remain in suspension and thereby assume and remain in a substantially toroidal shape. By "toroidal" shape is meant here and throughout the specification that the gases are caused to flow not only in a circular fashion forming a cylindrical doughnut shape around the widest internal circumference of the chamber with respect to the central axis of the processing chamber but also create a spiral flow of jets of hot gas around the internal circular axis of the doughnut shape so formed. The mode of entry of the hot gas is so controlled by a series of spaced baffles or blades, which suitably form an annulus at the base of the chamber, that the creation of a toroidal shape is facilitated and accentuated. The rate of flow of the hot gas into the processing chamber is so controlled that the gas acts as a support medium for a bed of particulate material which is kept afloat and in suspension above the support medium rather on the principle of a 'hovercraft'. The toroidal shape of the particulate bed and the direction of flow of the hot gas also causes the incoming polymer to assume the toroidal shape and intermingle substantially thoroughly and uniformly with the particulate material of the bed. A particularly suitable apparatus of this type which can be used in the process of the present invention is claimed and described in the published EP-A-O 068 853, the disclosure of which is incorporated herein by reference. In this publication, the apparatus described also acts on the 'hovercraft' principle and uses a momentum of exchange between a gas stream (the hot gas) and a mass (the polymer). By inverting the flow of the gas stream and by channelling the gas stream through a series of blades, the resultant linear jets of gas act as a support medium for a shallow bed (50–75mm in depth) of particles which can be floated over the gas stream. The blades convert the pressure head in the gas stream into a velocity head and, by suitable blade design, forces can be exerted on the bed causing it to lift and be transported horizontally. This exchange of energy is one of the fundamental differences between a fluidized bed reactor and the apparatus of EP-A-O 068 853, the so called "TORBED ®" reactor, in which a toroidal bed of particulate material is achieved.

In the case of the TORBED ®, the momentum of the gas stream, which is normally the product of mass flow and its velocity, for a given bed may be supported either by a low velocity gas stream with a high mass flowrate, or, by a high velocity gas stream with a correspondingly low mass flowrate.

The ability to control the momentum of the hot gas as described above enables the use of particulate bed materials having large-size range distributions. Thus the shape of the particulate bed material being processed need not be spheroidal; they may be flakes, rings, extrudates or of other irregular shapes.

In the TORBED ®, the blades are formed into an annulus at the base of the process chamber thereby enabling maximum exposure of all the material in the particulate bed to the area in which the velocity of the gases are at a maximum.

The hot gas is preferably inert under the reaction conditions to the polymer being cracked or the low molecular weight products produced thereby. Examples of gases that may be used include hydrogen, nitrogen, steam, carbon monoxide, carbon dioxide, other flue gases (which may comprise ethane, propane and mixtures thereof and which may be the by-products of the polymer cracking reaction or of steam/catalytic cracking of naphthenes, paraffins etc) which are substantially free of oxygen. Of these, nitrogen is preferred.

The heating for the gas to generate a hot gas may be provided by burners located suitably beneath the annular baffles/blades at the base of the processing chamber. The hot gas may be a mixture of gases and combusted air e.g. from combustion of hydrocarbon mixtures.

The polymer is suitably cracked at a temperature in the range from 300–600° C. Within this range, a temperature of 300–450° C. is suitably used if the particulate bed used contains a catalyst. In the absence of any catalytic material in the particulate bed, the temperature used is preferably higher and can be up to 600° C.

The residence time of the polymer in the processing chamber is suitably very short and is preferably of the order of less than 20 seconds, most preferably from 1–3 seconds in order to generate the desired products of lower molecular weight from the polymer.

The process of the present invention can be carried out by a batch process or by a continuous process. It is preferable to use a reactor in which the slag or inactive beds or other particulate contaminants in the polymer being cracked are withdrawn through a central discharge facility at the base of the reactor whereas the exit gases containing the desired products of lower molecular weight are recovered from the top of the reactor.

The process of the present invention enables the polymers to be cracked into products of relatively lower molecular weight than the starting materials. These products of lower molecular weight volatilize and/or are entrained in the gases exiting the processing chamber. The products of lower molecular weight comprise one or more of waxes, lubricating oils, paraffinic hydrocarbons, naphthenes and other monomers. The desired products can be recovered from the gases exiting the chamber e.g. by condensation. If desired, some of the products may be further treated to improve the value thereof. For instance, the paraffinic and naphthenic hydrocarbons resulting from the polymer cracking process may be steam cracked further to produce lower olefins.

The present invention is further illustrated with reference to the following Examples:

EXAMPLE 1

A TORBED ® T400 reactor (with a 400 cm diameter chamber with each blade ca. 5–7cm long) supplied by Davy Mckee Ltd and having a configuration described in EP-A-0 068 853, was provided with a side burner and air blower, a side exit port and a batch feed hopper. The reactor contained a resident bed of fused alumina (750g anti-bumping granules, ex BDH Ltd) which was caused to circulate toroidally about the axis of the chamber. The bed was heated to 350° C. using propane as the fuel gas. Samples of polyethylene particles (37.8 g linear low density polyethylene, MW 106,000, ex BP Chemicals SNC, Lavera) were fed into the reactor batchwise by the feed hopper at the top of the reactor and introduced into the circulating alumina granules. After a contact time of 1–2 seconds in the reactor, an aerosol spray type mist entrained in the gases exiting the reactor was collected, condensed and found to contain a waxy product. This waxy product on analysis by gas chromatography was found to contain a mixture of hydrocarbons, mainly having 30 to 40 carbon atoms.

EXAMPLE 2

The above process was repeated but now using a heted nitrogen feed fed at the rate of 200 $cm^3$/hr (NTP). The particulate bed was that of zirconia pellets (2 Kg, 2–5 nun diameter, ex Brown & Tawse Ltd) and the same polyethylene grade as above(6 Kg) was fed via a screw feeder at the rate of 6 Kg/hr. The reactor was run at a temperature of 500° C. The resultant product was a wax which was collected via a water scrubber and analysis of the wax by HPLC showed it to contain a broad range of hydrocarbons containing 25–120 carbon atoms with a predominating amount of these having 40–80 carbon atoms.

We claim:

1. A process for the conversion of a polymer, especially hydrocarbon polymers, into products of lower molecular weight than the starting polymer, said process comprising:

a. generating in a processing chamber of circular cross-section in its vertical orientation a stream of hot gas which flows in an angular and upward direction causing (i) a bed or particulate material to be entrained in the flow of the gas and held in suspension in a toroidal shape and (ii) the polymer introduced into said chamber in turn to intermingle with the particulate material and assume said toroidal shape thereby cracking said polymer at a temperature in the range from 300–600° C. into products of lower molecular weight and (iii) recovering said products of lower molecular weight from said chamber.

2. A process according to claim 1 wherein the polymer is introduced into the reactor as strips, pellets, extrudates or as a melt.

3. A process according to claim 1 wherein the polymer is selected from polyethylene, polypropylene, polystyrene, PVC or polyethylene terephthalate.

4. A process according to claim 1 wherein the polymer is a waste polymer.

5. A process according to claim 1 wherein the bed of particulate material comprises catalytic materials, non-catalytic materials or mixtures thereof.

6. A process according to claim 1 wherein the bed of particulate material comprises one or more of a zeolite, clay or amorphous silica-alumina, silica, quartz, alumina, zirconia, incineration pellets and calcium oxide.

7. A process according to claim 1 wherein the hot gas is selected from hydrogen, nitrogen, steam, carbon dioxide, carbon monoxide, flue gases and mixtures thereof which are substantially free of oxygen.

8. A process according to claim 1 wherein the polymer is cracked at a temperature in the range from 300–600° C.

9. A process according to claim 1 wherein the residence time of the polymer in the processing chamber is less than 10 seconds.

10. A process according to claim 1, wherein the polymer is cracked and uses a momentum of exchange between the gas and the polymer.

11. A process according to claim 10 wherein the flow of the gas is inverted and channelled through a series of baffles or blades converting the pressure head in the gas stream into a velocity head and lifting and transporting the bed or particulate material.

* * * * *

UNITED STATES PATENT AND TRADEMARK OFFICE

CERTIFICATE OF CORRECTION

PATENT NO. : 5,354,930

DATED : October 11, 1994

INVENTOR(S) : MARTIN P. ATKINS and DAVID A. KIDD

It is certified that error appears in the above-indentified patent and that said Letters Patent is hereby corrected as shown below:

Col. 1, l. 63, place a hyphen (-) between "by" and "products"

Col. 4, l. 53, should read "2-5 mm diameter,"

Col. 6, claim 11, last line, change "or" to --of--

Signed and Sealed this

Thirty-first Day of January, 1995

*Attest:*

*Attesting Officer*

BRUCE LEHMAN

*Commissioner of Patents and Trademarks*